United States Patent [19]

Haavik

[11] 4,323,334

[45] Apr. 6, 1982

[54] TWO STAGE LIQUID RING PUMP

[75] Inventor: Harold K. Haavik, South Norwalk, Conn.

[73] Assignee: The Nash Engineering Company, Norwalk, Conn.

[21] Appl. No.: 121,293

[22] PCT Filed: Aug. 9, 1979

[86] PCT No.: PCT/US79/00586

§ 371 Date: Jan. 25, 1980

§ 102(e) Date: Jan. 25, 1980

[87] PCT Pub. No.: WO81/00438

PCT Pub. Date: Feb. 19, 1981

[51] Int. Cl.[3] ..... F04C 19/00

[52] U.S. Cl. ..... 417/68; 417/244

[58] Field of Search ..... 417/68, 69, 244

[56] References Cited

U.S. PATENT DOCUMENTS

| | | | |
|---|---|---|---|
| 3,108,738 | 10/1963 | Luhmann | 417/68 |
| 3,217,975 | 11/1965 | Jennings | 417/68 |
| 3,366,314 | 1/1968 | Schroder | 417/68 |
| 3,721,508 | 3/1973 | Mugele | 417/68 |
| 4,083,658 | 4/1978 | Ramm | 417/68 |
| 4,132,504 | 1/1979 | Fitch | 417/68 |

FOREIGN PATENT DOCUMENTS

| | | | |
|---|---|---|---|
| 617521 | 8/1935 | Fed. Rep. of Germany . | |
| 823170 | 12/1951 | Fed. Rep. of Germany . | |
| 1116339 | 11/1961 | Fed. Rep. of Germany . | |
| 1037582 | 5/1953 | France | 417/68 |
| 691425 | 5/1953 | United Kingdom . | |
| 858422 | 1/1961 | United Kingdom . | |

*Primary Examiner*—Carlton R. Croyle
*Assistant Examiner*—Edward Look
*Attorney, Agent, or Firm*—Robert R. Jackson; John A. Howson

[57] ABSTRACT

Discharge or unloading orifices are provided in both stages of the two stage pump to bleed seal liquid under various vacuum conditions and to render the pump immune to the effects of variation in rotor speed and in the delivery rate of seal liquid.

9 Claims, 4 Drawing Figures

TWO STAGE LIQUID RING PUMP

BACKGROUND OF THE INVENTION

This invention is concerned with a liquid ring pump. Such a pump essentially comprises a bladed rotor mounted within an eccentric casing into which ring liquid or seal liquid is introduced and, under the centrifugal force produced by rotation of the rotor, is caused to form a ring following the interior contour of the casing. The blades of the rotor and the inner surface of the ring define working chambers or buckets which are alternately brought into communication with inlet and outlet ports and into which a gas is admitted during a suction stroke and from which the gas is expelled as the bucket volume contracts.

Different porting techniques are adopted for admitting gas to the buckets and for allowing the exit of gas from the buckets. For example, a so-called center port pump is known in which the gas enters and leaves the buckets radially. A side port pump is known in which the gas enters and leaves the pump axially. Combinations of those two types of pump are also known in which one of the inlet and outlet ports communicates radially with the buckets while the other communicates axially with the buckets.

Additionally, the pumps may have casings which define a single lobe such that there is one operational cycle per revolution of the rotor or the casing may define multiple lobes, there being as many cycles per revolution as there are lobes. It will be recognized from the following description that the subject matter herein is applicable to the various kinds of pumps.

The invention is specifically concerned with pumps of the two stage kind that is to say is concerned with pumps comprising a first pumping stage, the outlet of which is connected to the inlet of a second pumping stage, the second pumping stage being of lesser capacity than the first pumping stage. One pump of this general kind is described in German Pat. No. 823,170.

It is well known that in two stage pumps the first stage is constructed with several times the volumetric displacement capacity of the second stage. At low vacuum levels the first stage pump discharges a gas volume rate greater than that which can be handled by the second stage, i.e. a gas volume rate in excess of the capacity of the second stage. If the second stage has a full liquid ring and the interstage, i.e. the connection between the first and second stages, is not otherwise vented, the excess volume of gas passed from the first stage over that which can be accommodated by the second stage, is trapped which results in high pressures between the first and second stages. This situation results in such performance problems as a high power requirement, reduced first stage capacity and surging, i.e. unstable pumping action. Attempts to solve this problem have included the provision of a bypass check valve to vent the excess of the pump's capacity, the check valve opening whenever the volume of gas moved by the first stage exceeds that which can be handled by the second stage. This solution is generally adequate but, of course, relies upon a mechanical device for its effectiveness and the valve is subject to breakdown or malfunction.

An alternative technique is described in the aforementioned German patent specification. In that patent there is provided an unloader hole in the second stage which is effective to bleed seal liquid from that stage to decrease the thickness of the liquid ring and necessarily, therefore, to increase the capability of the second stage to permit the gas to pass directly from its inlet to its discharge. This method also relies on a valve to regulate the amount of liquid discharge from the second stage and, of course, one configuration or valve setting providing for a specific discharge at a nominal operating condition does not give good performance characteristics at different speeds and seal flow rates. Further, this latter method is one which does not provide tolerance to seal flow variations and to rotor speed variations.

BRIEF SUMMARY OF THE INVENTION

According to this invention, it is proposed that both stages of a two stage liquid ring vacuum pump be provided with unloader orifices. The angular and radial location of the unloader orifices has been determined to be of crucial importance and can be selected to render the pump substantially immune to the effects of variations in rotor speed or variations in the delivery rate of fresh seal liquid. The maintenance of a seal water reservoir for recirculation of the unloader liquids at high vacuum further renders the pump less sensitive to fresh seal liquid rate changes. These advantages and others are discussed in greater detail infra.

DESCRIPTION OF THE DRAWINGS OF THE SPECIFICATION

Embodiments of the present invention are illustrated in the accompanying drawings in which.

DESCRIPTION OF THE PREFERRED EMBODIMENTS

Figure 1:
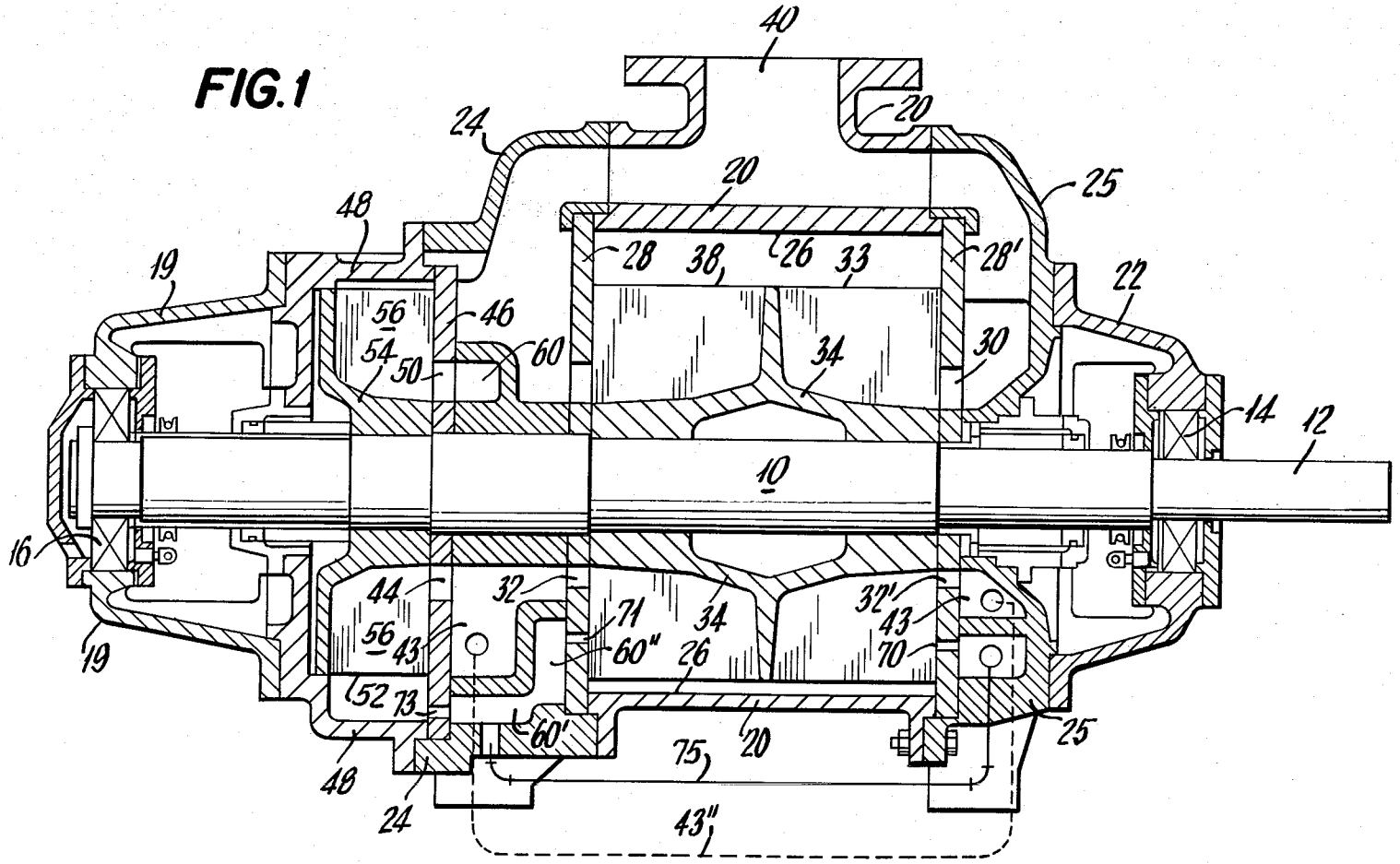
FIG. 1 shows, schematically and in eccentric longitudinal cross section, a pump according to this invention.

The pump in FIG. 1 is a two-stage liquid ring pump of the center head kind. It comprises a shaft 10 having a drive end 12 by which drive is imparted to it from a motor through, if necessary, an appropriate transmission. The shaft is mounted in bearing 14 within bearing bracket 22 at its drive end and in bearing 16 within bearing bracket 19 at its idle end.

The first stage of the pump comprises a casing 20 which is mounted between the drive end head structure 25 and a center head structure 24 described in more detail hereinafter. In the particular embodiment of the invention illustrated the pump is of the circular lobe type and the interior surface 26 of the casing is cylindrical and is eccentric to the shaft 10. The casing is closed by port plates 28, 28' provided with inlet openings 30 and discharge ports 32, 32' shown schematically in FIG. 1 and of known configuration. Keyed to the shaft 10 within casing 20 is a rotor 33 comprising a hub portion 34, and a plurality of radially disposed and axially extending blades 38 the free radial edges of which have a close clearance with the port plates 28, 28'.

Gas is admitted to the buckets through the first stage inlet passage 40 to the center head 24 and through the end head 25 and then on through inlet ports 30, 30'. The gas is then discharged through the first stage discharge ports 32, 32' on either side of the first stage and then into interstage passages 43, 43' which are interconnected by an external connection 43'' shown schematically in FIG. 1 but which, of course, may be integrally cast within the casing 20. Connection 43'' leads to an inlet port 44 of port plate 46 of the second stage pump. The second stage pump is constituted by a casing 48 and is closed by port plate 46 which includes a discharge port 50.

Within the casing 48 there is a rotor 52 comprising a hub 54 and a plurality of radially disposed and longitudinally extending blades 56. The casing is eccentric to the shaft and to the rotor on that shaft. Gas entering the second stage pump from the first stage pump through inlet port 44 is transported to discharge port 50 and thence to a discharge passage 60 in the center head.

The discharge passage 60 connects with a seal liquid reservoir 60' via channel 60'' within the center head so that the reservoir constantly receives ring liquid discharged through the port 50 and is maintained at the discharge pressure of the second stage pump.

Both the first stage and the second stage pumps of the embodiment of FIG. 1 are provided with relatively small unloading orifices, the locations of which are discussed in greater detail hereinafter with particular regard to FIG. 2 and those orifices depicted diagrammatically in FIG. 1 as the drive-end first stage unloader orifice 70, idle end first stage orifice 71 and second stage unloader orifice 73, communicate with the seal liquid reservoir 60' either directly, through external tubing 75 or by means of channels 60'' formed in the center head.

Passage 60'' and reservoir 60' are so positioned that they are continually flooded and when either or both the first or second stage casing pressures in the unloader orifice locations go to vacuum, the reservoir liquid will recirculate from the second stage discharge to the first and second stage casings. At high vacuum this recirculation renders the pumps less sensitive to fresh seal liquid rate changes.

Figure 2:
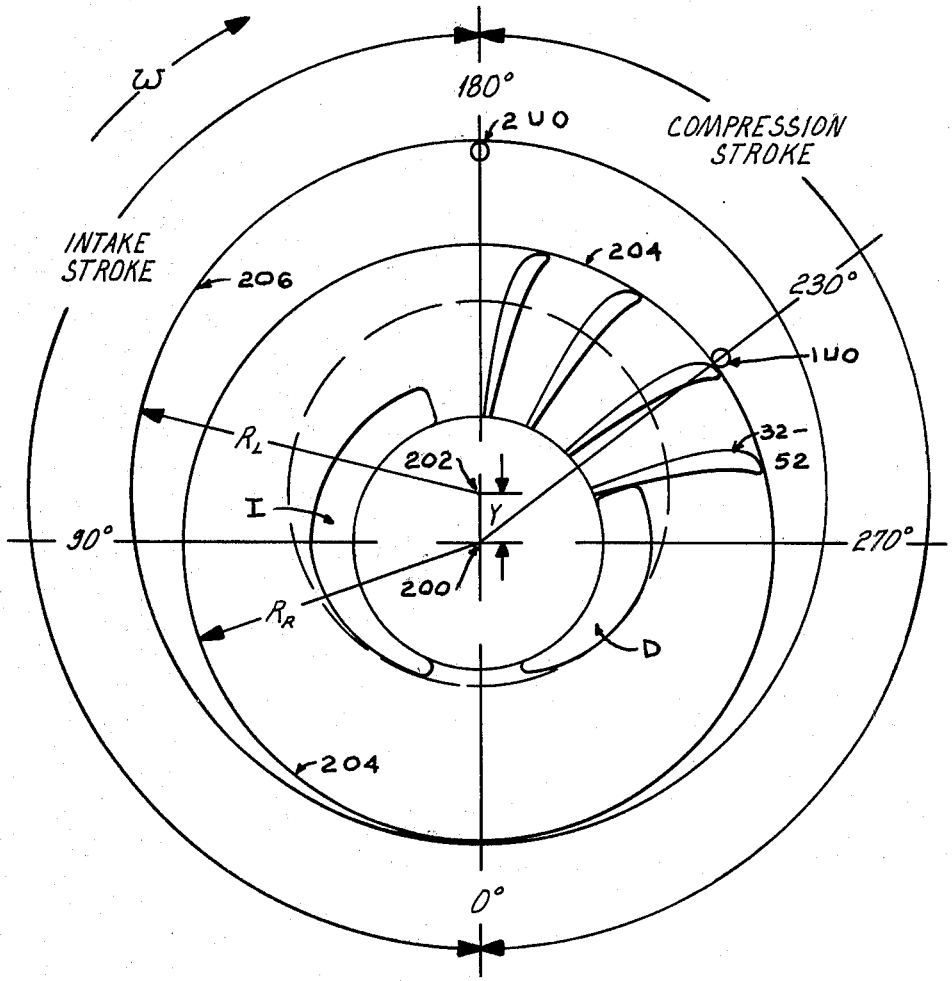
FIG. 2 is a diagram illustrating the disposition of the unloader orifices according to the present invention.

FIG. 2 illustrates, diagrammatically, the disposition of the unloader orifices. Specifically, FIG. 2 is in effect a diagrammatic end view of the pump with the shaft axis at 200 and the lobe axis at 202 so that the eccentricity Y is the spacing between the two axes. The land, of course, is at the zero degrees position.

The outer peripheral edge of the rotor 33–52 is indicated at 204 and the rotor radius is indicated at $R_R$. The casing or lobe radius is indicated at $R_L$ and the inner surface of the lobe is indicated at 206.

The rotor turns in the direction indicated by the arrow W.

The intake or inlet port is indicated at I and the discharge port at D. It is to be appreciated that the diagram in FIG. 2 is common to the pump of FIG. 1 and as such inlet port I corresponds to ports 30, 30' and 44 of the embodiment of FIG. 1 discharge port D corresponds and to the discharge ports 32, 32' and 50.

It is to be noted that in the particular embodiment illustrated, the intake stroke is essentially from 0° to 180° with the intake port normally contained within these angles. The discharge stroke is from 180° to 360° with the discharge port normally defined within these angles.

In the particular embodiment of the invention illustrated it has been determined that for the considerations herebelow, the optimum disposition of the first stage unloader orifice 1UO is approximately 230° and slightly beyond the periphery of the rotor.

For the second stage unloader orifice 2UO, it has been determined that the optimum position is between 20° and 180° from land and at the outermost portion of the lobe defining casing.

Figure 3:
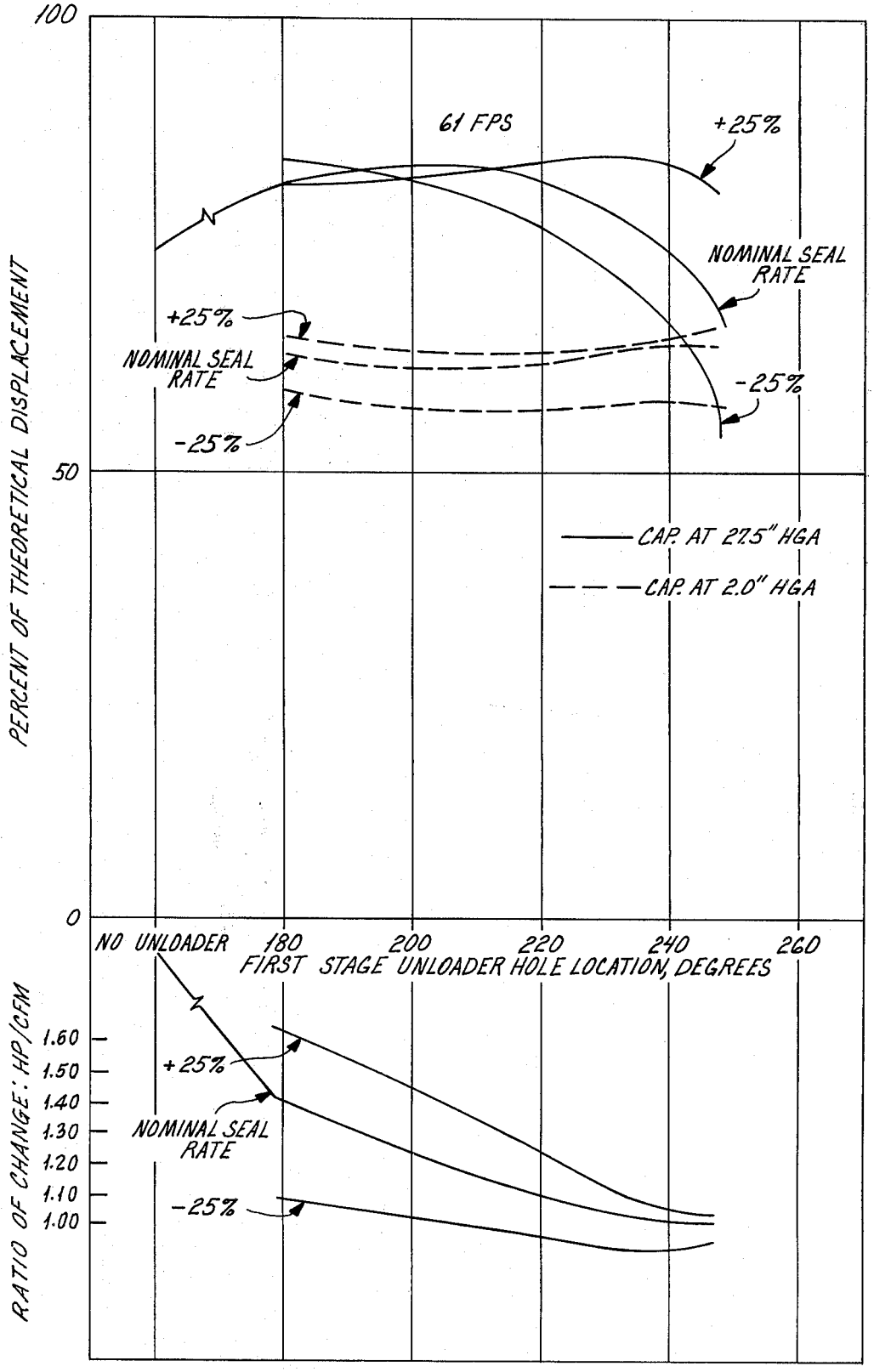
FIGS. 3 and 4 are plots showing the results of tests conducted with equipment according to the present invention.
Figure 4:
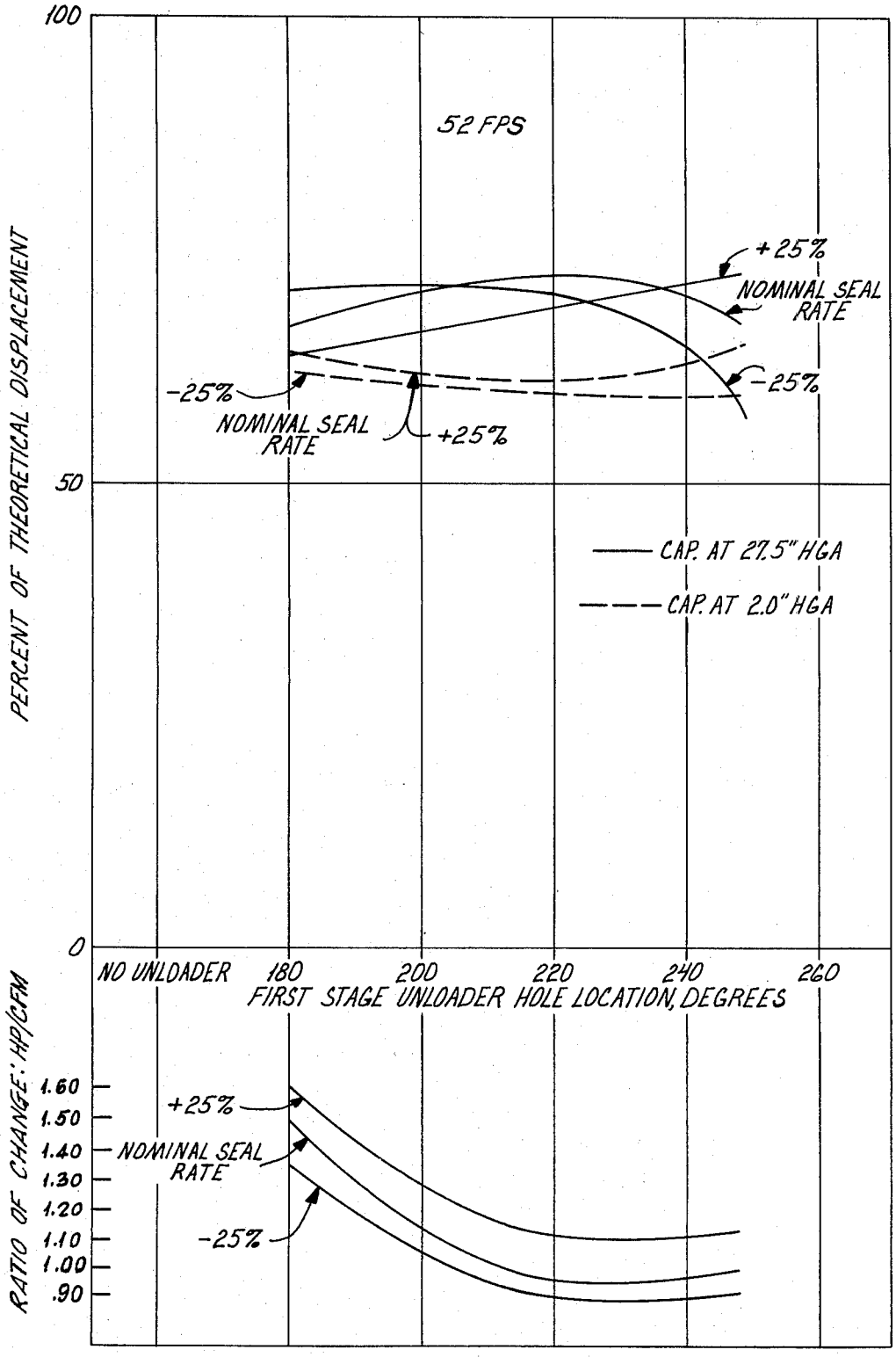

The effects of the unloader orifices and the positions of those orifices can be determined from the consideration of FIGS. 3 and 4.

From a consideration of the graphs now to be discussed, it is concluded that the particular disposition of the unloader orifices in the first stage gave good tolerance to a variation of seal flow from a nominal flow rate or over a range of approximately plus and minus 25%. Similarly, the configuration worked well for the rotor tip speed ranging from 50 to 65 FPS over the whole operating range of the pump without poor performance characteristics such as excessive power, surging, and/or excessive capacity loss.

FIG. 3 is a graph in which the capacity of the pump for different locations of the unloader orifice in the first stage are shown and upon which also the horsepower per capacity measure is plotted against angular location of the first stage unloader orifice. Referring to the curves at the upper part of FIG. 3 they show the operation of the pump for a nominal seal delivery rate plus or minus 25%. The full line plots show the capacity at 27.5" HgA while the dash line curves show the capacity at 2" HgA.

The three lower plots show the performance expressed in horsepower per actual cubic feet per minute at 27.5" HgA. Again, the curves are of the conditions prevailing for the nominal seal rate plus or minus 25% delivered to the pump.

The minimum value for horsepower per cubic feet per minute for the nominal seal rate is used as a base to compare the HP/CFM at different unloader orifice locations. In this respect the value of 1.00 is determined for the pump having the unloader orifice at 250° with the nominal seal rate and at the rotor tip speed of 61 FPS. As can be seen approximately 40% more horsepower is required with the orifice at 180° than at 250° with the nominal seal liquid rate.

The parts on the graph in FIG. 4 are substantially similar to those in FIG. 3 but are the results obtained by testing a pump rotated at a tip speed of 52 feet per second.

The graphs demonstrate the effect of the angular location of the unloader orifice of the first stage on the overall pump performance, i.e., the low and high vacuum displacement figures and the low vacuum power requirement per unit of volumetric displacement.

The primary consideration is the hp/cfm figures which for both speeds is at or close to a minimum for angular locations greater than 215° and up through 250°. The second most significant effect is seen to be on low vacuum capacity which, especially for the lower seal rate drops rapidly as the angular location increases from 180° to 250°. The optimum location of around 230° balances a combination of low hp/cfm and higher low vacuum capacity. It is to be noted that the high vacuum cfm is not greatly affected by the angular location of the unloading orifice.

From a consideration of these curves, a pump designer would almost always want the first stage unloader orifice to be located at 215° or further from land. According to present considerations an optimum location is 230° from land. However, if one ignores the low vacuum capacity criteria, the optimum location would be closer to 250° from land which gives the lowest power requirement on the hp/cfm curve and gives slightly better overall high vacuum capacity. Also, a pump operated at low speed only will operate well with the hole location at 250° from land.

It will be quite apparent to one skilled in the art by appropriately selecting the position of the unloader orifice in the first stage one can derive a combination of characteristics as desired.

As noted hereabove, by the appropriate selection of the position of the unloader orifice, certain advantages accrue, those advantages including, the tolerance of a two-stage vacuum pump to speed change; the tolerance of such a pump to variations in seal liquid flow; good performance of a two-stage vacuum pump with a fixed seal flow rate over its entire operating range and good performance with no interstage bypass check valve which, of course, is subject to mechanical failure or misfunction.

At low vacuums, the first stage discharges a gas volume rate in excess of the capacity of the second stage. If the second stage has a full liquid ring and the interstage is not otherwise vented, the excess capacity is trapped in the interstage resulting in high interstage pressures. This situation creates the problems discussed supra. As noted hereabove, the techniques adopted to correct this situation have been the inclusion of an interstage bypass check valve and the unloading of the second stage as described in the aforementioned German patent 823,170. According to the teaching of that German patent, proper sizing of the unloading orifice relieves sufficient water from the second stage lobe at low vacuum to decrease the liquid ring thickness and increase the capacity of the second stage to bypass gas.

The seal unloading system of the present invention works well because, among other things, it takes advantage of naturally occurring pressure distributions within the pump. In the first stage, the placing of the unloader orifice in the compression zone approximately 230° from the land is optimized because in this position it senses the highest internal air pressure occurring in the first stage. Over compression in the bucket occurs in this region of the compression stroke at the low vacuum high mass flow rate condition. According to test measurements the unloader pressure is high in the range of 15 to 30" HgA first stage inlet pressure and then tends to fall off quickly at inlet pressures less than 15" HgA. Since the rate of seal discharge through the unloader is proportional to the square root of this pressure, once one has resolved to unload the first stage, it can be seen that the seal unloading rate from the first stage will be high at high absolute pressures and will decrease rapidly at pressures less than 15".

Such a flow characteristic is favorable because it diverts a majority of the total seal supply which would otherwise have to be pumped by the second stage to be discharged directly in the range of 15 to 30" HgA suction pressure. Below 15 inches mercury absolute the bypass flow decreases rapidly It is believed that this flow characteristic accounts in part for the good power characteristic of the pump at low vacuum since the second stage receives a small supply of seal liquid which is easily discharged through its unloader orifice. Thus, the second stage liquid ring replenishment is minimized at low vacuum.

In comparision to the method described in the German Pat. No. 823,170 this new method allows a much smaller orifice diameter for the second stage unloader since at low vacuum it must unload only a small percentage of the seal flow to the pump (because of the diverted first stage flow), whereas the German proposal must be capable of discharging nearly 100% of the flow. This is important when the second stage is operating at high vacuum where it is desirable to minimize the unloading rate from the second stage to obtain peak performance of this unit. The larger orifice of the German patent design (especially since it is located on the discharge side) is sensitive to pump speed and delivered seal flow to the pump and has to be throttled or otherwise controlled by some external means for operation under conditions other than those for which the pump is specifically designed. This requirement for a throttling valve in line is, of course, a disadvantage since it is a part subject to mechanical failure and also requires adjustment for varying conditions.

Another characteristic of the present invention is the fact that the second stage unloading orifice can be located anywhere within the intake stroke because the pressure distribution is essentially constant with respect to circumferential location in this region. Location on the inlet side also tends to minimize the discharge pressure and flow of this unloader as the second stage goes to high vacuum since the lobe pressure tracks the second stage suction pressure.

What is claimed is:

1. In a two-stage liquid ring pump including (1) first and second stages, each stage including (a) a casing, (b) a rotor disposed within the casing, (c) an intake port communicating with an intake stroke area within the casing, and (d) a discharge port communicating with a discharge stroke area within the casing, and (2) interstage conduit means connecting the first stage discharge port to the second stage intake port, the improvement comprising:

a seal liquid unloader orifice in the first stage casing adjacent the first stage discharge stroke area and disposed so that the unloader orifice is normally covered by the ring of seal liquid in the first stage; and seal liquid conduit means communicating with the unloader orifice outside the first stage casing, the seal liquid conduit means communicating with the second stage discharge port and being maintained at the pressure of the second stage discharge port.

2. A pump as claimed in claim 1 wherein said unloader orifice of said first stage is disposed at an angular location of between 215° and 250° from the land in the direction of rotor rotation.

3. A pump as claimed in claim 2 wherein said unloader orifice is disposed close to the periphery of the first stage rotor.

4. A pump as claimed in claim 2 wherein said unloader orifice of said first stage is disposed at about 230° from the land in the direction of rotor rotation and close to the peripheral edge of the first stage pump rotor.

5. A pump as claimed in claim 1 wherein said unloader orifice is disposed close to the periphery of the first stage rotor.

6. A pump as claimed in claim 1 wherein the improvement further comprises a seal liquid unloader orifice in the second stage casing, said second stage unloader orifice being disposed within an angular location including the intake stroke area and close to the periphery of the second stage pump casing.

7. A pump as claimed in claim 6 wherein the second stage unloader orifice communicates with the seal liquid conduit means.

8. A pump as claimed in claim 7 wherein the first and second stage unloader orifices are normally covered by seal liquid in the seal liquid conduit means.

9. The liquid ring pump of claim 1 in which the portion of the seal liquid conduit means adjacent the unloader orifice is continually flooded with seal liquid during operation of the pump.

* * * * *